US005363979A

United States Patent [19]

Thorso

[11] Patent Number: 5,363,979

[45] Date of Patent: Nov. 15, 1994

[54] CONTAINER HAVING A LOOSE INNER LINING

[75] Inventor: Holger Thorso, Esbjerg, Denmark

[73] Assignee: Superfos Emballage A/S, Vipperod, Denmark

[21] Appl. No.: 90,186

[22] PCT Filed: Mar. 16, 1992

[86] PCT No.: PCT/DK92/00083

§ 371 Date: Jul. 22, 1993

§ 102(e) Date: Jul. 22, 1993

[87] PCT Pub. No.: WO92/16421

PCT Pub. Date: Oct. 1, 1992

[30] Foreign Application Priority Data

Mar. 19, 1991 [DK] Denmark ..... 0493/91

[51] Int. Cl.[5] ..... B65D 25/16

[52] U.S. Cl. ..... 220/404

[58] Field of Search ..... 220/404, 403, 908, 909, 220/570, 400

[56] References Cited

U.S. PATENT DOCUMENTS

| | | | |
|---|---|---|---|
| 2,082,995 | 6/1937 | Wilcox | 220/404 |
| 3,790,021 | 2/1974 | Bailey . | |
| 4,094,432 | 6/1978 | Zilbert . | |
| 4,867,340 | 9/1989 | Byers . | |
| 5,031,767 | 7/1991 | Bruno | 220/404 |
| 5,076,462 | 12/1991 | Perrone | 220/909 |
| 5,160,063 | 11/1992 | Bailey | 220/404 |
| 5,211,305 | 5/1992 | Horton | 220/404 |

FOREIGN PATENT DOCUMENTS

| | | | |
|---|---|---|---|
| 145194 | 11/1980 | Denmark . | |
| 3838182 | 6/1989 | Germany . | |
| 674503 | 6/1990 | Switzerland . | |
| 1533744 | 11/1978 | United Kingdom | 220/404 |
| 2103173 | 2/1983 | United Kingdom . | |
| 2170471 | 8/1986 | United Kingdom . | |
| 2205297 | 12/1988 | United Kingdom . | |

*Primary Examiner*—S. Castellano

*Attorney, Agent, or Firm*—Watson, Cole, Grindle & Watson

[57] ABSTRACT

A circular container for storage and transport of paint and solvents is made of a resiliently deformable plastic material and includes a side wall which defines first and second portions above an external flange, the first and second portions being separated by a folding and bending arrangement. The second wall portion is bendable outwardly and downwardly relative to the first wall portion. A bag of propylene or PET is positioned in the container and an upper portion thereof is folded around the second wall portion and is held in place by ring tension generated when the free edge of the second wall portion is bent to abut an upper edge of the flange.

3 Claims, 3 Drawing Sheets

CONTAINER HAVING A LOOSE INNER LINING

BACKGROUND OF THE INVENTION

The invention relates to an circular container of a resiliently deformable plastics material, e.g. for storage and transport of paint, solvents or the like. Such containers are well known in particular in the form of 5 or 10-liter containers, optionally stackable containers or pots which close to their upper circumference may be provided with an external flange of the same material as the container and moulded in one piece with the container to tightly secure a removable lid which is also made from resiliently deformable plastics, the lid being constructed with a corresponding flange arrangement which engages with the flange of the container, cf. e.g. DK-C-145,194.

The ever increasing environmental considerations shown especially in the industrialized countries have in several countries, e.g. Germany, now resulted in statutory provisions stipulating that containers of the above mentioned type are to be returned to the supplier after terminated use for optional recircling or controlled destruction. However, as residues of paint or solvent contained in such containers may constitute a risk for the members of the staff which are to handle the returned containers, the container should be provided with a disposable insert, e.g. a bag of propylene, PET (polyethylene terephthalate) or similar plastics material having barrier properties to protect the internal container wall against the influences of the contents or deposits of the contents of the container so as to allow the bag with optional residues of the contents to be removed from the container for separate destruction before the container is returned as empty packing to the supplier.

Up to now such insert bags have been placed in the container prior to filling of the container, the rim of the bag being folded around the upper upright portion of the side wall of the container and the resilient lid ("flex-lid") subsequently being pressed down over the edge and over the container flange to close the container. When the lid is subsequently removed for use of the contents in the container, it simultaneously tends to push the upper edge of the insert bag free of the container rim, which results in drawbacks such as the insert bag sliding down into the contents in the container and consequently not protecting the internal container wall sufficiently, or in difficulties in "fishing" the bag out of the contents and resecuring it to the upper portion of the side wall, when only part of the contents has been used and the container has been closed temporarily until further use of the contents.

SUMMARY OF THE INVENTION

Therefore, it is the object of the invention to provide a container of the above mentioned type having an insert bag therein and which remedies the above drawbacks by permanently securing the insert bag to the upper edge of the side wall substantially independently of whether a lid is on the container or not.

The object is obtained by means of a container having an outwardly-extending flange near the top of its side wall and wherein the side wall above the flange is divided into first and second portions separated by a folding and bending arrangement such that the second portion can bend outwardly and downwardly towards the flange and thus secure thereto a bag whose upper wall portion is positioned therearound.

The invention will be explained in further detail below with reference to the drawings which without limiting the scope of the invention illustrates e.g, an embodiment of the invention.

DETAILED DESCRIPTION OF THE PREFERRED EMBODIMENT

Figure 1:
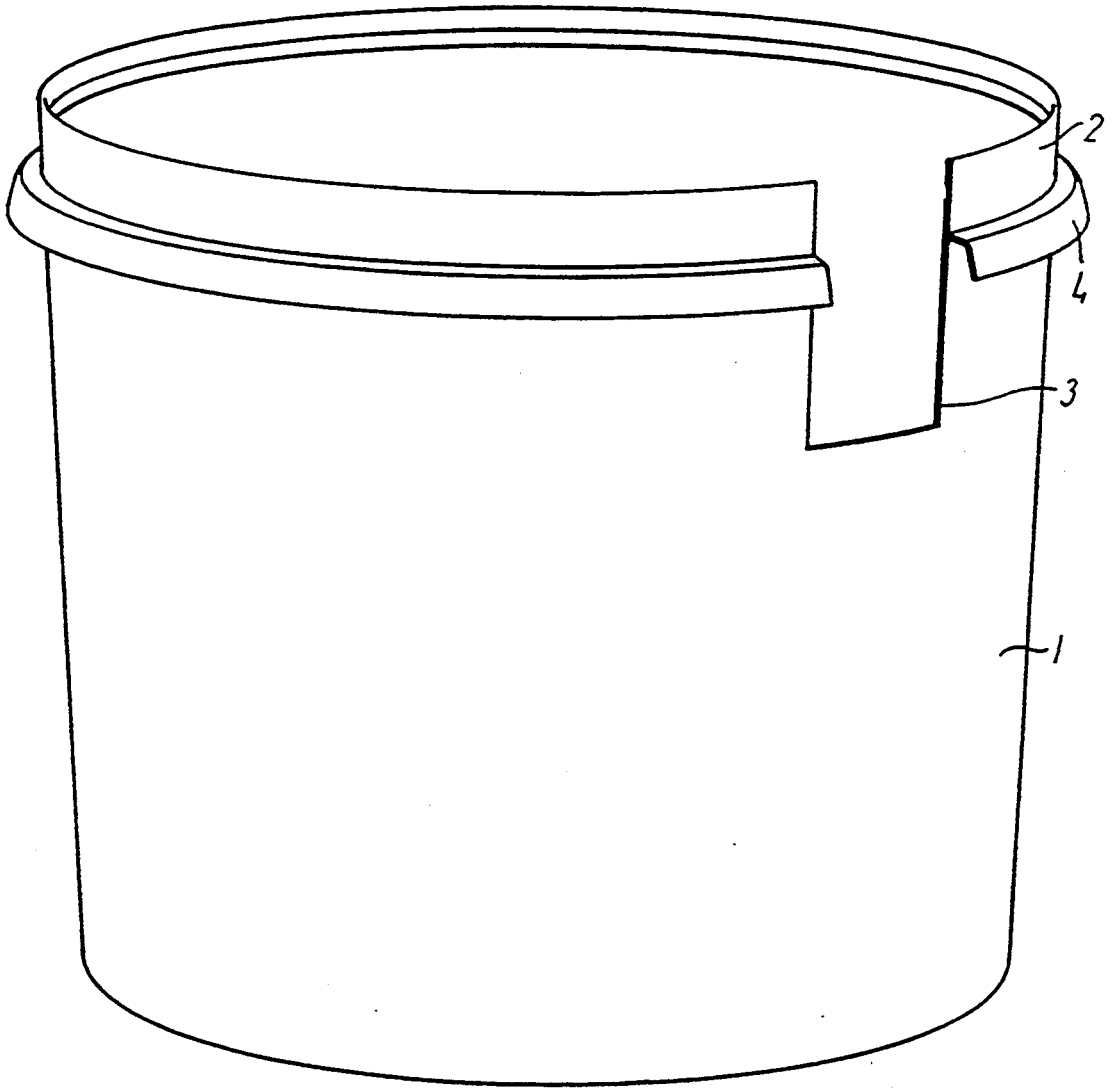
FIG. 1 shows a perspective view of a circular container or a pot for paint and the like, FIG. 2 shows a sectional view of the upper portion of the side wall of the container and an inserted bag prior to its folding around the upper portion of the container wall.
Figure 2:
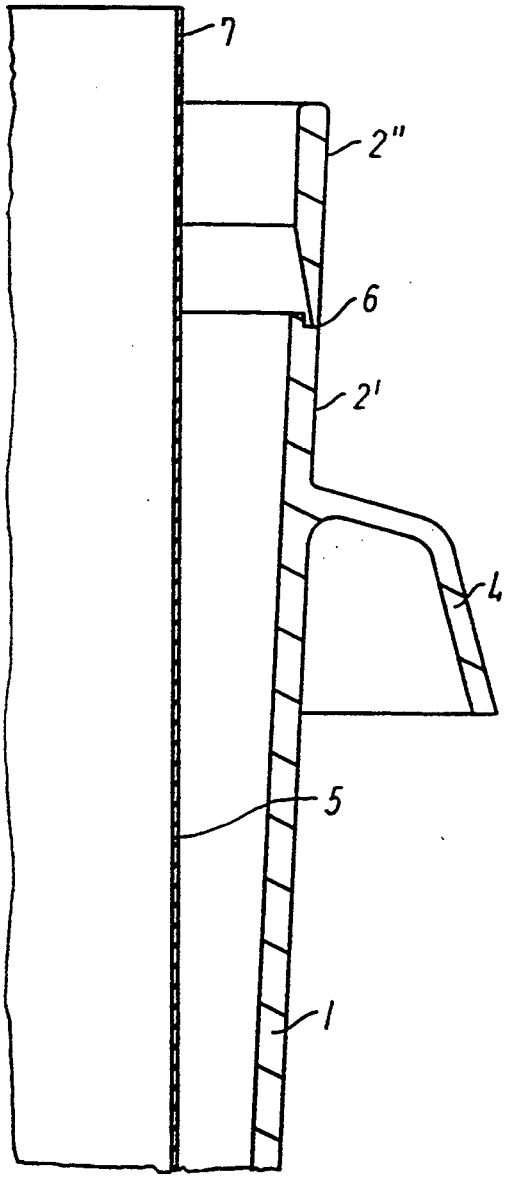

FIG. 1 shows a circular, stackable container having a vertical side wall 1 which on its outside at the top is provided with a container flange 4 to be used in connection with a container lid, cf. below, and with a cut-out 3 in the side wall 1 to increase the resiliency in the upper portion of the side wall. The upper portion of the side wall above the flange 4 is designated as 2. As will appear from FIGS. 2–4, this upper portion is divided into two further wall portions, namely a first wall portion and a second wall portion 2″ by a folding and bending arrangement 6 in a radial plane of the container. An insert bag 5 is inserted into the container as will appear from FIG. 2, the upper portion 7 of the vertical side wall of the insert bag being somewhat longer than the corresponding container side wall 1,2.

Figure 3:
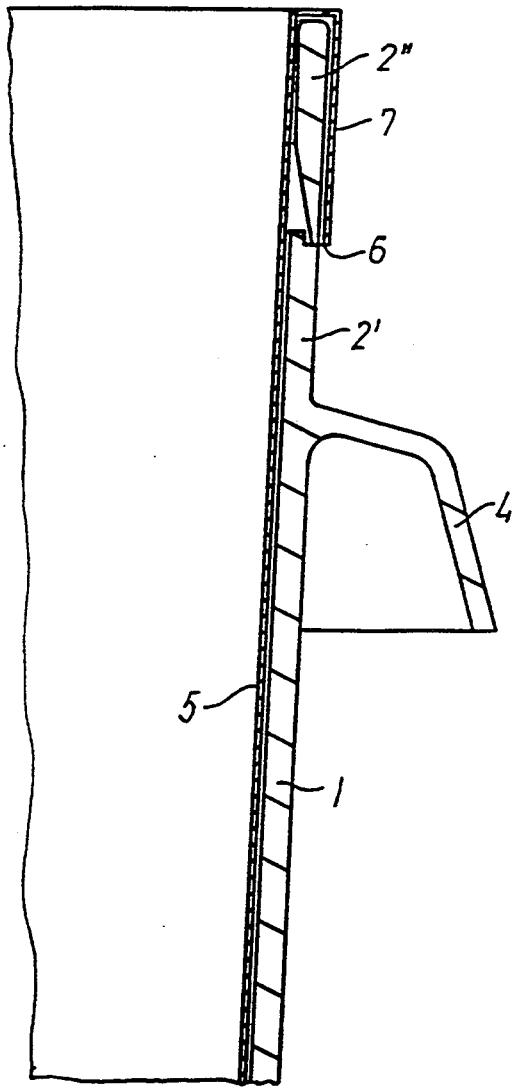
FIG. 3 shows a sectional view of the side wall with the inserted bag folded around the upper portion of the wall.
Figure 4:
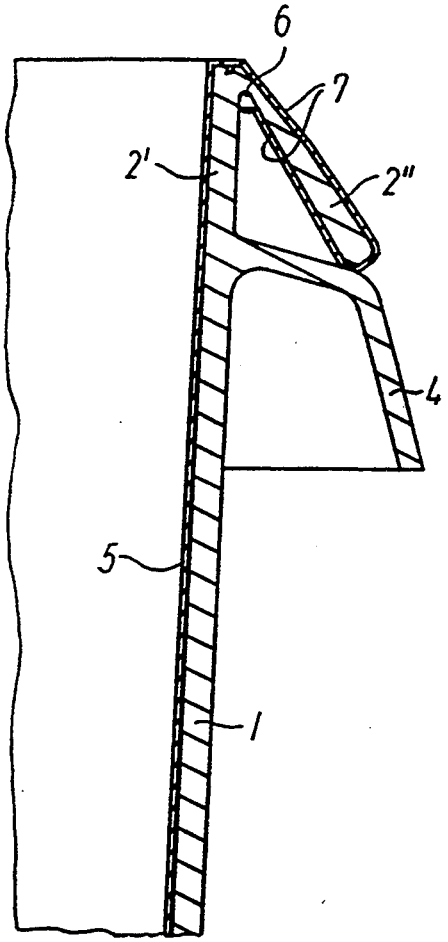
FIG. 4 shows the same as FIG. 3 but after bending the upper portion of the container wall with the inserted bag.

FIG. 3 shows the bag 5 with its upper portion 7 folded around the upper second portion 2″ of the container side wall prior to the bending of the latter around the bending arrangement 6, and FIG. 4 shows the side wall with the inserted bag after the portion 2″ has been bent outwards and downwards so that the now downwards turning edge 2″ abuts on the upper edge of the flange 4 and forms an angle with the first portion 2′ so that the position of the second portion 2″ produces a ring tension along the outer edge of said portion to secure the bag portion 7 thereto due to a corresponding ring tension being provided in the bag portion 7.

The outward and downward bending of the second wall portion 2″ is facilitated by the extra resiliency contributed to the container wall 1 by means of the cut-out 3. The cut-out also facilitates the return of the second wall portion 2″ to an upright position when removing the insert bag 5.

Figure 5:
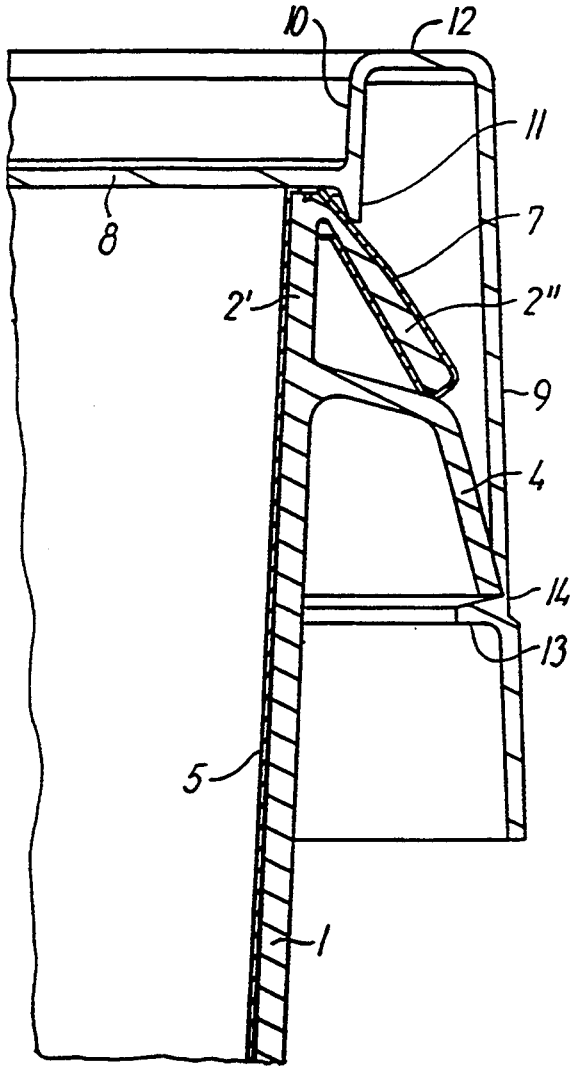
FIG. 5 shows a sectional view corresponding to the one shown in FIG. 3 and with a container lid secured to the container.

FIG. 5 shows how a container lid 8 known per se ("flex lid") is placed on the container in which an insert bag 5 is placed and secured. Along its periphery the lid 8 is provided with a flange arrangement consisting of an inner flange 10, a rim portion 12 and an outer flange or a lid flange 9. The latter has a thin-walled part or a bending arrangement 14 with an appertaining locking rip which, when placed to engage under the downward-turning edge of the container flange 4, forms a tight closure between the lid and the container. The internal flange 10 of the lid extends downwards together with a guide rib 11 which abuts on the portion now constituting the upper end of the wall portion 2'' when the container is closed with the lid 8, thereby maintaining the portion 2'' in its bended position, and together with the ring tension in the portion 2'' and the abutment of the latter on the flange 4 contributing to secure the insert bag 5 and due to the direct abutment furthermore forming an extra sealing between the container and the lid.

I claim:

1. A container for paint and solvents comprising: a circular container of a resiliently deformable plastics material, an inner lining in the form of a bag of plastics material having barrier properties to protect the plastic container against the influences from its contents being placed in the container, the container close to an upper circumference thereof being provided on an outside thereof with a flange of plastics material and moulded in one piece with the plastics container, and a resiliently deformable plastic lid secured to the container, wherein a portion of a side wall of the container protruding above the flange is divided into two portions, a first portion and a second portion, by a folding and bending arrangement, the first portion forming an unbroken extension of the side wall of the container, whereas the second portion bends outwardly and downwardly towards an upper edge of the flange due to the bending arrangement to abut on the upper edge of the flange, at a top thereof the side wall of the container is provided with a cut-out which ensures a sufficient extra resiliency of the second side wall portion, and the bag has a sufficient length to bend outwardly and downwardly together with the second portion towards the upper edge of the flange, thereby causing a ring tension in the second portion and in the portion of the bag which bends with the second portion of the side wall, the ring tension contributing in securing the bag portion around the second wall portion.

2. A container according to claim 1, wherein the height of the first and second portions and the width of the upper edge of the flange are such that through its downwards bending a top edge of the second portion is caused to abut on an outer portion of the upper edge of the flange so that the forces resulting from the ring tension in the second portion contribute to secure the bag portion around the wall portion.

3. A container according to claim 1, in which the lid along an outer periphery thereof is provided with a downward-turning lid flange having an inwardly-directed circular locking rib which in a mounted position of the lid engages under a downwardly-turning edge of the container flange and, the locking rib is bendable to release from the flange due to a thin-walled part, the lid has an inner flange portion provided with a downwardly-turning guide rib keeping the container wall portion in a downwardly bent position when the lid is mounted and further ensures that the portion of the bag which bends with the second portion of the side wall is maintained on the second portion in said downwardly bent position.

* * * * *